US007488060B2

(12) United States Patent
Umeda

(10) Patent No.: US 7,488,060 B2
(45) Date of Patent: Feb. 10, 2009

(54) LIQUID SUPPLYING APPARATUS AND LIQUID EJECTING APPARATUS

(75) Inventor: Takaichiro Umeda, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 292 days.

(21) Appl. No.: 11/276,441

(22) Filed: Feb. 28, 2006

(65) Prior Publication Data

US 2006/0192820 A1 Aug. 31, 2006

(30) Foreign Application Priority Data

Feb. 28, 2005 (JP) ..... 2005-053451

(51) Int. Cl.
*B41J 2/175* (2006.01)

(52) U.S. Cl. ..... 347/85

(58) Field of Classification Search ..... 347/85, 347/86, 87; 141/2, 18

See application file for complete search history.

(56) References Cited

U.S. PATENT DOCUMENTS 4,510,510 A * 4/1985 Terasawa ..... 347/30
4,628,333 A * 12/1986 Terasawa ..... 347/87
5,047,790 A * 9/1991 Cowger et al. ..... 347/87
5,841,454 A * 11/1998 Hall et al. ..... 347/87
6,257,715 B1 * 7/2001 Thielman et al. ..... 347/92
6,540,321 B1 4/2003 Hirano et al.
6,629,758 B2 10/2003 Okamoto et al.
6,755,500 B2 6/2004 Hirano et al.
6,837,921 B2 * 1/2005 Inoue et al. ..... 96/6
6,846,072 B2 * 1/2005 Sato et al. ..... 347/86

FOREIGN PATENT DOCUMENTS

JP 1998336980 A 12/1996
JP 2001301190 A 10/2001
JP 2001301194 A 10/2001
JP 2002200774 A 7/2002
JP 2003001849 A 1/2003
JP 2003226025 A 8/2003
JP 2004009450 A 1/2004

* cited by examiner

*Primary Examiner*—Anh T. N. Vo
(74) *Attorney, Agent, or Firm*—Baker Botts L.L.P.

(57) ABSTRACT

A liquid supplying apparatus for supplying a liquid to an ejecting device. The liquid supplying apparatus includes a liquid storage device, a supply device, a first gas-permeable membrane, and a gas blocking liquid. The liquid storage device, including a reservoir having an atmosphere communication hole in an upper portion of the reservoir, stores the liquid. The supply device applies pressure to the liquid and supplies the liquid to the liquid storage device. The first gas-permeable membrane, which is permeable to gas but impermeable to liquid, is disposed in the atmosphere communication hole. The gas blocking liquid, filled in the atmosphere communication hole on the atmosphere side of the first gas-permeable membrane, prevents entry of gas from the atmosphere side.

6 Claims, 7 Drawing Sheets

LIQUID SUPPLYING APPARATUS AND LIQUID EJECTING APPARATUS

CROSS-REFERENCE TO RELATED APPLICATIONS

This application claims the benefit of Japanese Patent Application No. 2005-53451 filed Feb. 28, 2005 in the Japanese Patent Office, the disclosure of which is incorporated herein by reference.

BACKGROUND

The present invention relates to a liquid supplying apparatus that includes a liquid storage device storing liquid and a supplying device pressurizingly supplying the liquid to the liquid storage device, and supplies the liquid stored in the liquid storage device to an ejection device, and relates to a liquid ejecting apparatus provided with the liquid supplying apparatus.

In a typical conventional recording head of an inkjet recording apparatus, a sub-tank is installed to temporarily store ink to be supplied to the recording head. When an ink cartridge is replaced for replenishment of ink into the sub-tank, air is likely to enter into and be accumulated inside the sub-tank. When ink is supplied to the sub-tank using an ink supply tube made of a material having air-permeability, air which enters through the wall of the ink supply tube little by little over a long time period will be accumulated inside the sub-tank.

During formation of an image, such air accumulated inside the sub-tank is mixed into ink to be ejected from the recording head. This sometimes causes an ink ejection failure, resulting in a lower quality of a formed image.

There is a known technology to discharge air which has entered into the sub-tank. According to the technology, an atmosphere communication hole is provided in an upper portion of the sub-tank, and the atmosphere communication hole is provided with a gas-permeable membrane, which is permeable to gas but impermeable to liquid, in order to separate the inside of the sub-tank and the atmosphere. In this case, ink is pressurizingly supplied into the inside of the sub-tank periodically, and only air accumulated inside the sub-tank is discharged.

However, there is a problem that backflow of air into the inside of the sub-tank cannot be prevented by only using the gas-permeable membrane. According to the above described technology, air is discharged to the outside of the sub-tank through the gas-permeable membrane when ink is pressurizingly supplied into the sub-tank. At the time of image information, however, a negative pressure is caused inside the sub-tank as the ink is decreased, so that air flows back into the inside of the sub-tank through the gas-permeable membrane. Accordingly, it is required to provide a check valve, besides the gas-permeable membrane, for preventing backflow of air when a negative pressure is caused inside the sub-tank, such as at the time of image formation.

SUMMARY

One aspect of the present invention may provide a liquid supplying apparatus that easily and securely prevents entry of gas into the inside of a liquid storage device such as a sub-tank without using a check valve or the like.

In the one aspect of the present invention, there is provided a liquid supplying apparatus for supplying a liquid to an ejecting device. The liquid supplying apparatus includes a liquid storage device, a supply device, a first gas-permeable membrane, and a gas blocking liquid.

The liquid storage device, including a reservoir having an atmosphere communication hole in an upper portion of the reservoir, stores the liquid. The supply device applies pressure to the liquid and supplies the liquid to the liquid storage device. The first gas-permeable membrane, which is permeable to gas but impermeable to liquid, is disposed in the atmosphere communication hole. The gas blocking liquid, filled in the atmosphere communication hole on an atmosphere side of the first gas-permeable membrane, prevents entry of gas from the atmosphere side.

According to the liquid supplying apparatus configured as above, the inside of the liquid storage device and the atmosphere are separated by the first gas-permeable membrane disposed in the atmosphere communication hole. Also, the gas blocking liquid is filled in the atmosphere side of the atmosphere communication hole separated by the first gas-permeable membrane.

Accordingly, when the liquid is pressurizingly supplied by the supply device, gas in the inside of the liquid storage device is discharged through the first gas-permeable membrane to the outside of the liquid storage device. The discharged gas can pass due to buoyancy through the gas blocking liquid filled in the atmosphere side of the atmosphere communication hole separated by the first gas-permeable membrane, and thus is ultimately discharged into the atmosphere.

Also, even when the liquid is excessively supplied, the liquid is blocked by the first gas-permeable membrane, and will not flow out to the atmosphere side, i.e., to the outside of the liquid storage device. That is, leakage of the liquid can be prevented.

It is, therefore, possible to let out the gas accumulated in the inside of the liquid storage device without leakage of the liquid to the outside when the liquid is pressurizingly supplied by the supply device to the liquid storage device.

On the contrary, when the liquid is ejected from the ejecting device, causing a negative pressure in the inside of the liquid storage device, the gas is likely to enter into the inside of the liquid storage device through the atmosphere communication hole. However, the gas blocking liquid filled in the atmosphere communication hole prevents the gas from passing through the gas blocking liquid and from entering (i.e., flowing back) into the inside of the liquid storage device.

In other words, the first gas-permeable membrane and the gas blocking liquid filled in the atmosphere communication hole serve the same function as a check valve. It is, therefore, possible to prevent backflow of the gas using a simple gas backflow prevention mechanism including the first gas-permeable membrane and the gas blocking liquid without using a separate valve mechanism. Thus, accumulation of gas inside the liquid storage device can be prevented by the gas backflow prevention mechanism.

In another aspect of the present invention, there is provided a liquid ejecting apparatus, which includes the above described liquid supplying apparatus and an ejecting device that ejects the liquid stored in the liquid storage device provided in the liquid supplying apparatus toward an ejection target medium.

According to the liquid ejecting apparatus configured as above, including the above described liquid supplying apparatus supply of the liquid from the liquid storage device to the ejecting device cannot be prevented by gas accumulated in the inside. Therefore, the liquid is supplied always appropriately to the ejecting device, and the liquid is ejected in an accurate manner from the ejecting device.

It may be possible to apply the liquid ejecting apparatus of the present invention to an inkjet recording apparatus. In this case, the liquid (or ink) is ejected appropriately from the ejecting device (or a nozzle) to a target medium (or a sheet of recording paper), and thus printing with an improved image quality can be realized.

Also, it may be possible to use a curable liquid resin as a liquid to be ejected and a solid resin of the same material as an ejection target medium. In this case, the liquid resin may be ejected on the solid resin as the ejection target medium through the ejection device so as to form an array of concave surfaces or convex surfaces on the resin surface of the ejection target medium. Thus, manufacturing of a resin lens, such as a small array lens having small lenses formed in an array, can be realized.

BRIEF DESCRIPTION OF THE DRAWINGS

Preferred embodiments of the present invention will be described hereinafter with reference to the drawings, in which.

DETAILED DESCRIPTION OF THE PREFERRED EMBODIMENTS

First Embodiment

The present embodiment is an example of applying the present invention to a multifunction apparatus 1 including a printer function, a copier function, a scanner function, a facsimile function and a telephone function.

[Description of Configuration of Multifunction Apparatus 1]

Figure 1:
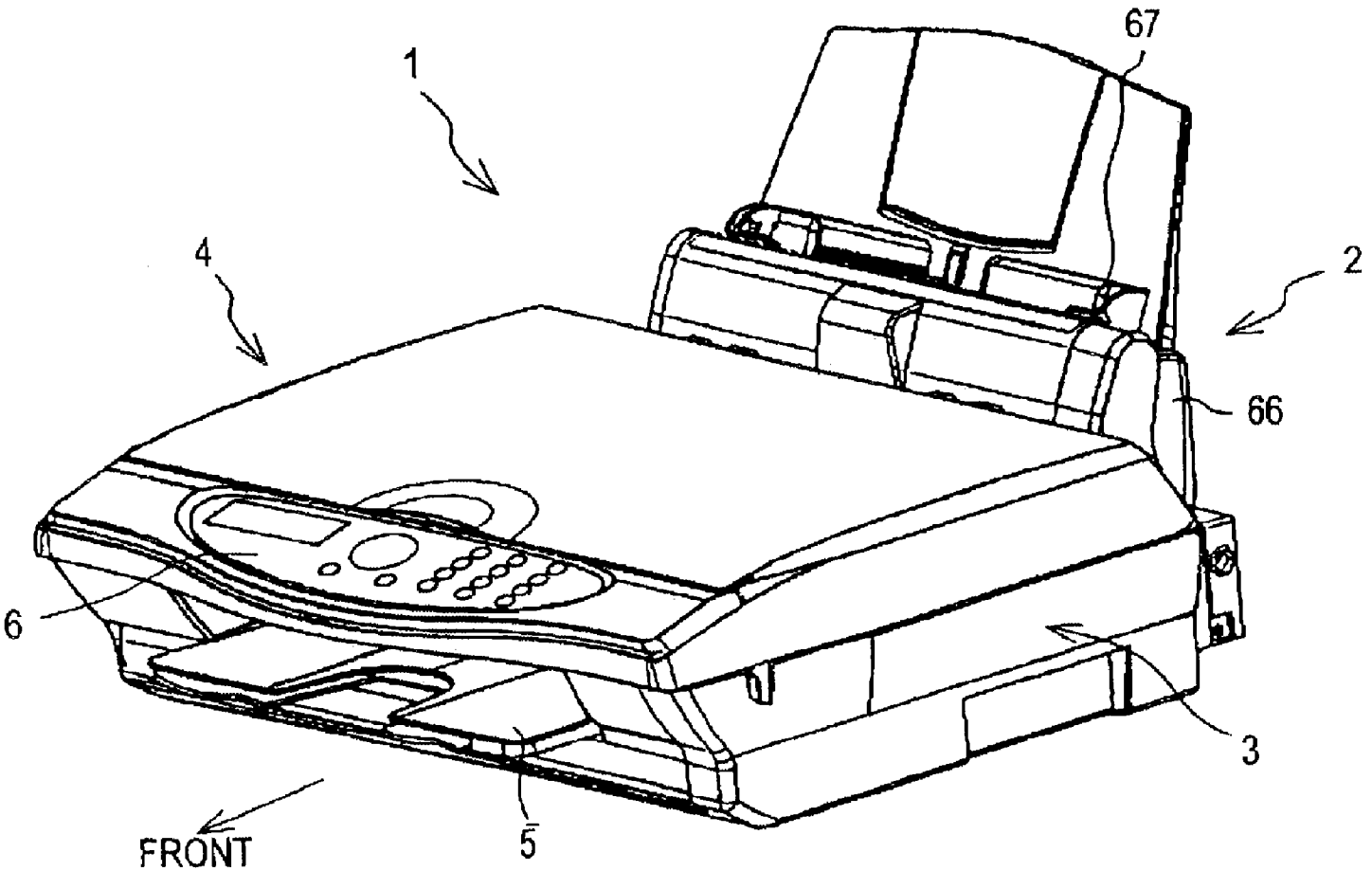
FIG. 1 is a perspective view showing a multifunction apparatus including a printer function, a copier function, a scanner function, a facsimile function, and a telephone function.

As shown in FIG. 1, the multifunction apparatus 1 includes a paper feeder 2 disposed at a rear end of the multifunction apparatus 1, an inkjet printer 3 disposed below and in front of the paper feeder 2, a reading device 4 for performing the copier function and the facsimile function disposed on the printer 3. A paper discharge tray 5 is disposed on a front side of the printer 3, and an operation panel 6 is disposed at a front end of an upper surface of the reading device 4.

The paper feeder 2 includes a slanting wall portion 66 for holding recording paper in a slanting state and an expandable paper guide plate 67 attachably/detachably fitted to the slanting wall portion 66. A plurality of sheets of recording paper can be stacked on the paper feeder 2. The slanting wall portion 66 houses a paper feed motor 65 (not shown in FIG. 1, see FIG. 3) and a paper feed roller (not shown). The paper feed roller rotated by a driving force of the paper feed motor sends the recording paper towards the printer 3.

[Description of Configuration of Printer 3]

Figure 2:
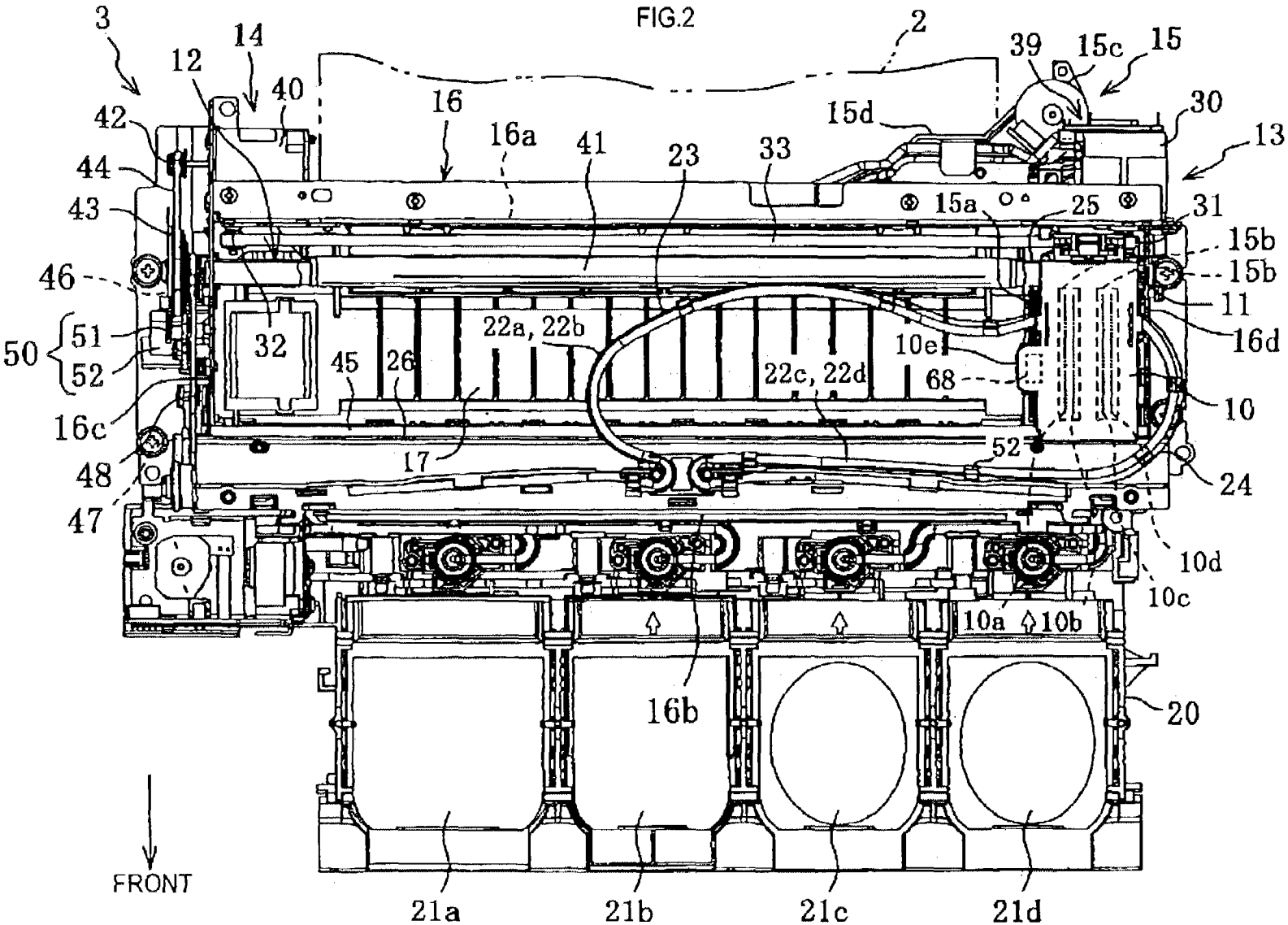
FIG. 2 is a plan view showing an internal structure of a printer portion included in the multifunction apparatus.

A description of the printer 3 will now be provided with reference to FIG. 2.

As shown in FIG. 2, the printer 3 includes a recording head 10, a carriage 11, a guide mechanism 12, a carriage moving mechanism 13, a paper conveying mechanism 14, and a maintenance mechanism 15 for the recording head 10. The recording head 10 is mounted on the carriage 11. The guide mechanism 12 guidingly holds the carriage 11 so as to be movable in right and left directions as a main scanning direction. The carriage moving mechanism 13 moves the carriage 11 in right and left directions. The paper conveying mechanism 14 conveys the recording paper fed by the paper feeder 2.

The printer 3 also includes a frame 16 having a rectangular configuration with a longer dimension in right and left directions and a shorter dimension in up and down directions in FIG. 2. The guide mechanism 12, the carriage moving mechanism 13, the paper conveying mechanism 14 and the maintenance mechanism 15 are mounted on the frame 16. In addition, the recording head 10 and the carriage 11 are housed in the frame 16 in a movable manner in right and left directions.

A rear side plate 16*a* of the frame 16 is provided with a paper introduction port (not shown), while a front side plate 16*b* is provided with a paper discharge port (not shown). The recording paper fed by the paper feeder 2 is introduced through the paper introduction port into the inside of the frame 16, is conveyed forward by the paper conveying mechanism 14 and is discharged through the paper discharge port to the paper discharge tray 5 (see FIG. 1) located in front of the paper discharge port.

A platen 17 having a plurality of ribs is mounted on a bottom surface of the frame 16. Within the frame 16, recording (i.e., image formation) is performed by the recording head 10 on the recording paper moving on the platen 17.

The recording head 10 is provided with four rows of ink nozzles 10*a*-10*d* facing downward. By downwardly ejecting four colors of ink (black, cyan, yellow and magenta) through the ink nozzles 10*a*-10*d*, an image is formed on the recording paper. The four rows of ink nozzles 10*a*-10*d*, which are provided under the recording heard 10, are indicated by dashed lines at positions seen through the recording head 10 in FIG. 2.

Each of the four rows of ink nozzles 10*a*-10*d* is constituted by, for example, 150 ink nozzles (not shown) aligned in the conveying direction of the recording paper for ejecting ink of the same color. The four rows of ink nozzles are arranged in order in the moving direction of the carriage 11.

Ink cartridges 21*a*-21*d* for four colors of ink mounted on a cartridge mounting portion 20 provided on a front side of the frame 16 are connected to the recording head 10 through four flexible ink tubes 22*a*-22*d* passing through the inside of the frame 16. The four colors of ink are supplied to the recording head 10 by means of pressure applied by a pressure pump 111 (not shown in FIG. 2, see FIG. 4).

Two flexible print circuits (FPC's) 23 and 24 are provided in the frame 16. The FPC 23 extends integrally with the two ink tubes 22*a* and 22*b*, and is connected to the recording head 10. The FPC 24 extends integrally with the two ink tubes 22*c* and 22*d*, and is connected to the recording head 10. A plurality of signal lines are provided on the FPC's 23 and 24 so as to electrically connect a control process unit 70 (not shown in FIG. 2) and the recording head 10.

The guide mechanism 12 includes a guide shaft 25 and a guide rail 26. The guide shaft 25 extends in right and left directions in the drawing of FIG. 2 in a rear portion inside the frame 16. Right and left ends of the guide shaft 25 are connected to a right side plate 16*d* and a left side plate 16*c* of the frame 16, respectively. The guide rail 26 extends in the right and left directions in a front portion in side the frame 16. A rear end portion of the carriage 11 is slidably penetrated by the guide shaft 25, while a front end portion of the carriage 11 is slidably joined with the guide rail 26.

The carriage moving mechanism 13 includes a carriage motor 30, a drive pulley 31, a driven pulley 32 and a belt 33. The carriage motor 30 is mounted on a rear face of the right end portion of the rear side plate 16*a* of the frame 16. The drive pulley 31 is rotatingly driven by the carriage motor so. The driven pulley 32 is rotatably supported by a left end portion of the rear side plate 16*a*. The belt 33 is wound around the pulleys 31 and 32 and fixed to the carriage 11. A carriage movement encoder 39 for detecting a moving amount of the carriage 11, in other words, for detecting a position of the recording head 10, is provided in the vicinity of the carriage motor 30.

The paper conveying mechanism 14 includes a paper conveying motor 40, a regist roller 41, a drive pulley 42, a driven pulley 43 and a belt 44.

The paper conveying motor 40 is mounted on a right face of a part of the left side plate 16*c* which extends rearward beyond the rear side plate 16*a*. The regist roller 41 is disposed under the guide shaft 25 inside the frame 16 such that an axial direction of the regist roller 41 is in the right and left direction. The regist roller 41 has a right end and a left end rotatably supported by the right side plate 16*d* and the left side plate 16*c*, respectively. The drive pulley 42 is rotatingly driven by the paper conveying motor 40, and the driven pulley 43 is connected to the left end of the regist roller 41. The belt 44 is wound around the drive pulley 42 and the driven pulley 43.

When the paper conveying motor 40 is rotated, the regist roller 41 is rotated so as to convey the recording paper in forward and backward directions. Although the regist roller 41 is shown in an emphasized manner in FIG. 2, the regist roller 41 is actually disposed under the guide shaft 25.

The paper conveying mechanism 14 also includes a paper discharge roller 45, a driven pulley 46, a driven pulley 47 and a belt 48. The paper discharge roller 45 is disposed in a front portion inside the frame 16 such that an axial direction of the paper discharge roller 45 is in the right and left direction. The paper discharge roller 45 has a right end and a left end rotatably supported by the right side plate 16*d* and the left side plate 16*c*, respectively. The driven pulley 46 is provided integrally with the driven pulley 43. The driven pulley 47 is connected to the left end of the paper discharge roller 45. The belt 48 is wound around the driven pulley 46 and the driven pulley 47.

When the paper conveying motor 40 is rotated, the paper discharge roller 45 is rotated so as to convey the recording paper forwardly toward the paper discharge tray 5.

An encoder disk 51 is fitted to the driven pulley 43, and a photo interrupter 52 having a light emitting portion and a light receiving portion sandwiching the encoder disk 51 therebetween is mounted on the left side plate 16*c*. The encoder disk 51 and the photo interrupter 52 constitute a paper conveyance encoder 50.

The control process unit 70 controls driving of the paper conveying motor 40 based on detected signals from the paper conveyance encoder 50 (specifically the photo interrupter 52).

A media sensor 68, as a downstream sensor, capable of detecting a front edge, a rear edge, side edges of the recording paper, or the like is provided in a left end portion of the recording head 10. Specifically, the media sensor 68, which is a reflective optical sensor including a light emitting portion (a light emitting element) and a light receiving portion (a light receiving element), is attached facing downward to a sensor attachment portion 10*e* extending leftward from the recording head 10.

A regist sensor (not shown), as an upstream sensor, capable of detecting presence/absence, the front edge, and the rear edge of the recording paper, is provided upstream from the media sensor 68 in the paper conveying direction (i.e., on a rear side of the media sensor 68), specifically at a front end portion of an upper cover of the paper feeder 2 constituting a conveying path.

The regist sensor may be constituted, for example, by a mechanical sensor having a detection probe extending into the recording paper conveying path and being rotated by the abutment of the recording paper during conveyance, a photo interrupter having a light emitting portion and a light receiving portion for detecting rotation of the detection probe, and a torsion spring for biasing the detection probe toward the paper conveying path.

A shielding portion is provided integrally with the detection probe. When the regist sensor is rotated by the recording paper during conveyance, the shielding portion is positioned other than in an area between the light emitting portion and the light receiving portion of the photo interrupter. Then, a light is transmitted from the light emitting portion to the light receiving portion, which causes the regist sensor to be in an ON state.

When the recording paper is not conveyed and the detection probe is biased by the torsion spring toward the paper conveying path, the shielding portion is positioned between the light emitting portion and the light receiving portion of the photo interrupter. Then, transmission of a light from the light emitting portion to the light receiving portion is blocked, which causes the regist sensor to be in an OFF state.

[Description of Configuration of Control Process Unit 70 (Control System of Printer 3)]

Figure 3:
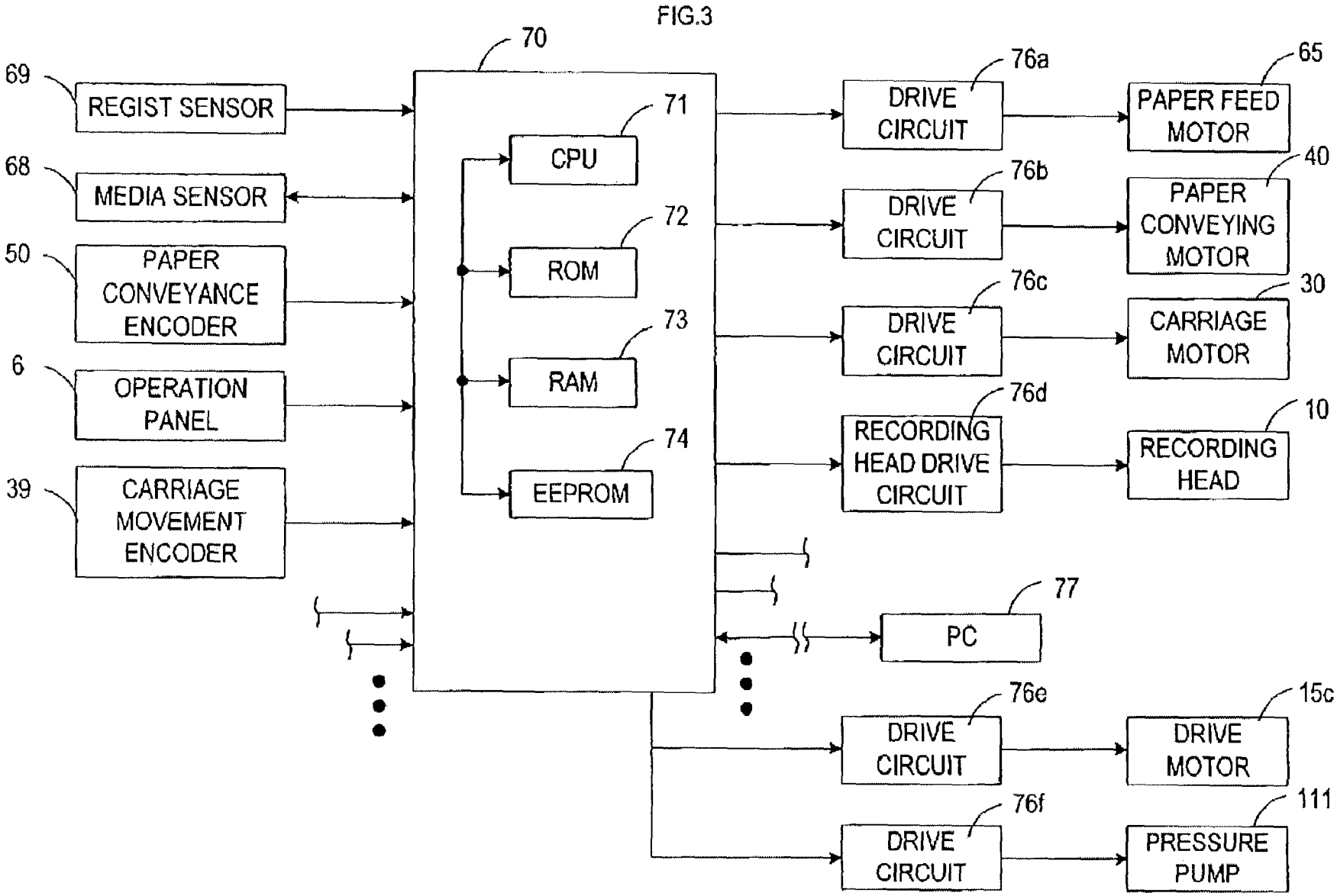
FIG. 3 is a block diagram showing a schematic configuration of a control process unit.

A description about the control process unit 70 will now be provided with reference to FIG. 3.

As shown in FIG. 3, the control process unit 70 as a relative position control portion is constituted by a microcomputer, including a CPU 71, a ROM 72, a RAM 73 and an EEPROM 74. The regist sensor 69, the media sensor 68, the paper conveyance encoder 50, the operation panel 6, carriage movement encoder 39 and others are electrically connected to the control process unit 70.

Also, drive circuits 76*a*, 76*b* and 76*c* for driving, respectively the paper feed motor 65, the paper conveying motor 40, and the carriage motor 30, are electrically connected to the control process unit 70. In addition, a recording head drive circuit 76*d* for driving the recording head 10, drive circuits 76*e* and 76*f* for driving, respectively, a drive motor 15*c* of the maintenance mechanism 15 and the pressure pump 111 are electrically connected to the control process unit 70. Furthermore, a personal computer 77 (a PC 77) may be connected to the control process unit 70.

When the control process unit 70 (specifically the CPU 71) receives a recording command on a sheet of recording paper P from the PC 77, a copier function block, a facsimile function block, or other function blocks in the multifunction apparatus 1, a paper edge detection process for detecting an edge position of the sheet of recording paper P is first executed. Then, a recording process for performing image formation on the sheet of recording paper P is executed based on a detection result.

When recording on the next sheet of recording paper P is necessary, the paper edge detection process and the recording process are executed again. When recording on the next sheet of recording paper P is unnecessary, the current process is terminated. The paper edge detection process and the recording process, which are executed according to the known art, will not be described here in detail.

The control process unit 70 drives the pressure pump 111 through the drive circuit 76*f* to thereby supply four colors of ink from the cartridges 21*a*-21*d* to sub-tanks 101*a*-101*d* of the recording head 10. Ink supply to the cartridges 21*a*-21*d* is periodically performed, and the pressure pump 111 is driven for a predetermined time period, in order to supply predetermined amounts of ink to the respective sub-tanks 101*a*-101*d*.

The ink supply to the sub-tanks 101*a*-101*d* need not be performed periodically. It may be possible to provide each of the sub-tanks 101*a*-101*d* with a liquid amount sensor for measuring a remaining amount of ink and to operate the pressure pump 111 to supply ink when the remaining amount of ink falls below a predetermined value. Alternatively, it may be possible to provide each of the sub-tanks 101*a*-101*d* with a pressure sensor and to stop operation of the pressure pump 111 when the pressure inside each of the sub-tanks 101*a*-101*d* reaches a predetermined value, instead of operating the pressure pump 111 for a predetermined time period to supply predetermined amounts of ink to the respective sub-tanks 101*a*-101*d*.

[Description of Configurations of Recording Head 10 and Backflow Prevention Mechanism 103]

The recording head 10 provided in the printer 3 and a backflow prevention mechanism 103 provided inside a sub-tank 101 of the recording head 10 will now be described with reference to FIG. 4 and FIG. 5.

Figure 4:
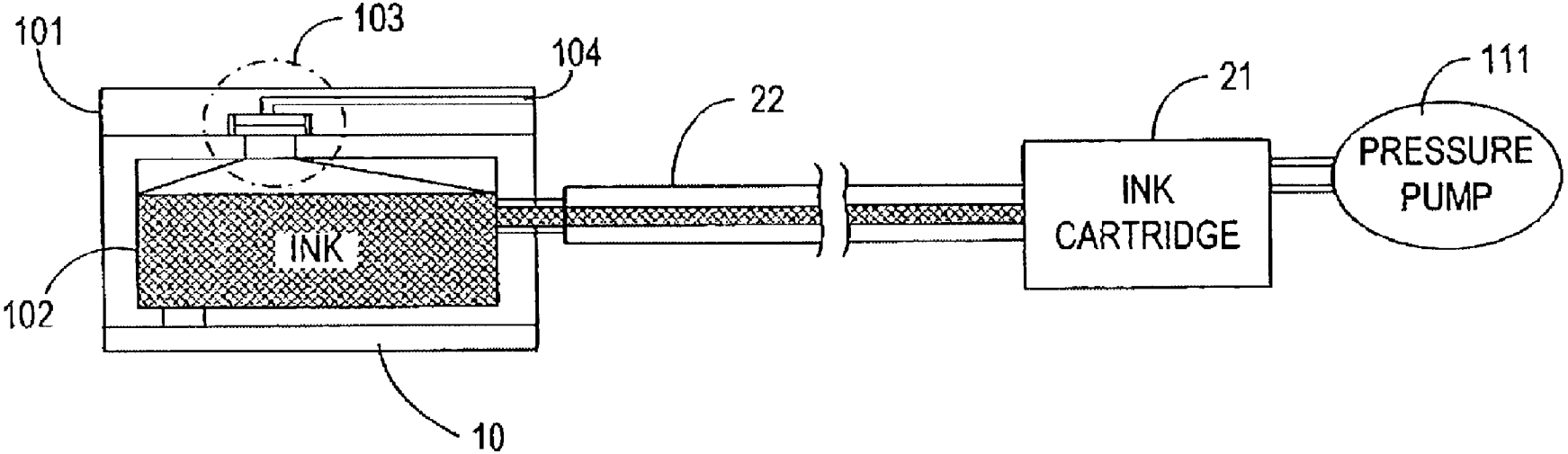
FIG. 4 is a schematic view showing a configuration of a recording head according to a first embodiment.

As shown in FIG. 4, the recording head 10 includes therein the sub-tanks 101*a*-10*d* (indicated by the sub-tank "101" in FIG. 4) for storing four colors of ink, respectively. The sub-tanks 101*a*-101*d* for the four colors of ink are connected to the respective rows of ink nozzles 10*a*-10*d* for the respective same colors. Thus, the respective colors of ink can be supplied from the sub-tanks 101*a*-101*d* to the rows of ink nozzles 10*a*-10*d* Since each of the sub-tanks 101*a*-101*d* has the game configuration, only a single sub-tank for a specific color of ink indicated by "the sub-tank 101" will be described below.

Figure 5B:
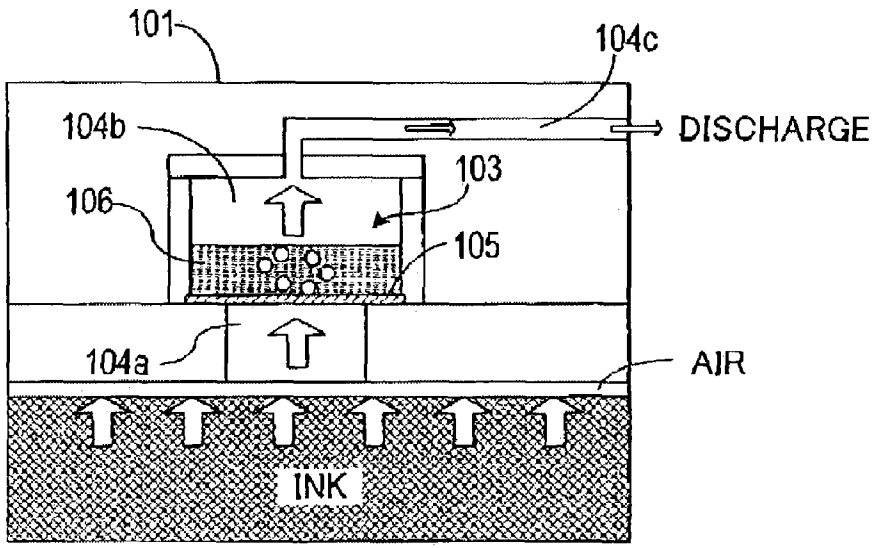
FIGS. 5A and 5B are schematic views showing a configuration of a sub-tank and a backflow prevention mechanism of the recording head in a normal state and in a pressurized state, respectively, according to the first embodiment.
Figure 5A:
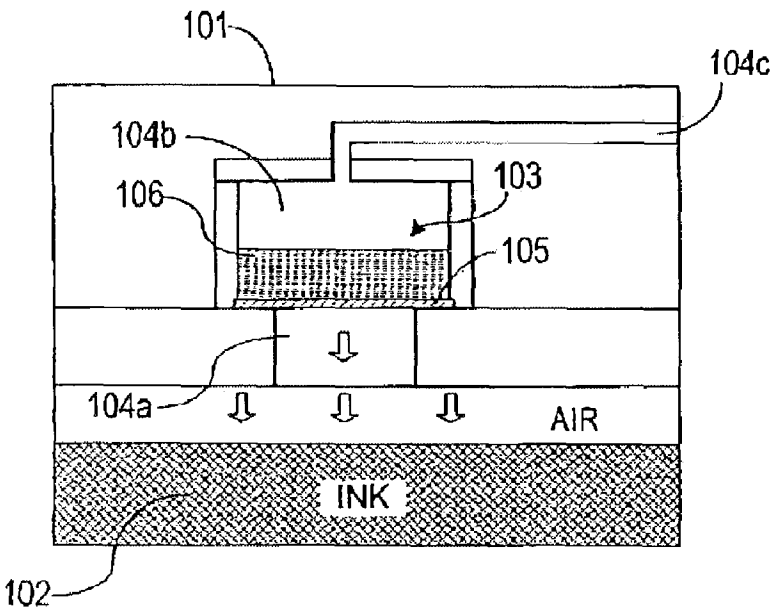

As shown in FIG. 5A, the sub tank 101 is provided with a tank main body 102, an atmosphere communication hole 104 for communicating the inside of the tank main body 102 with the atmosphere, and the backflow prevention mechanism 103 for discharging the air inside of the tank main body 102 to the outside while preventing the out side air from entering into the tank main body 102.

The backflow prevention mechanism 103 includes a gas-permeable membrane 105 and an oil 106. The gas-permeable membrane 105 is disposed so as to separate the inside of the tank main body 102 from the atmosphere in the middle portion (in a middle communication hole 104*b* in FIG. 5A) of the atmosphere communication hole 104 for communicating the inside of the tank main body 102 of the sub-tank 101 with the atmosphere. The oil 106 is a non-volatile liquid filled in the atmosphere side of the atmosphere communication hole 104 separated from the inside of the tank main body 102 by the gas-permeable membrane 105. A liquid other than the oil 106 may be filled in the atmosphere side of the atmosphere communication hole 104 as long as the liquid is non-volatile.

The atmosphere communication hole 104 includes a lower communication hole 104*a* communicating with the tank main body 102, a middle communication hole 104*b*, in which the gas-permeable membrane 105 and the oil 106 are disposed, and an upper communication hole 104*c* communicating with the atmosphere.

The upper communication hole 104*c* has a smaller diameter than the middle communication hole 104*b* and the lower communication hole 104*a* so as to cause a pressure loss sufficient to prevent leakage of the oil 106 filled in the middle communication hole 104*b* even when the sub-tank 101 is placed upside down with respect to the gravity direction.

The gas-permeable membrane 105 is made of a material which is permeable to air but impermeable to the oil 106. The gas-permeable membrane 105 includes micropores having pore diameters of 10 μm or less, or preferably of a few μm or less, and has a pressure resistance of 100 kpa or more.

The backflow prevention mechanism 103 configured as above operates as described below. When the pressure pump 111 is actuated to pressurizingly supply ink from the ink cartridge 21 to the tank main body 102, the liquid level of the ink rises to push up the air, as shown in FIG. 5B. The pushed up air passes through the lower communication hole 104*a*, and reaches the gas-permeable membrane 105. Since the gas-permeable membrane 105 has micropores (of a few μm) allowing the air to pass through, the air passes through the gas-permeable membrane 105 and enters into the oil 106. The air in the oil 106 gradually rises from a lower portion to an upper portion of the oil 106 due to buoyancy, and is released into a space within the middle communication hole 104*b*. The air further passes through the upper communication hole 104*c*, and is discharged into the atmosphere.

In contrast, during the image formation, the ink gradually decreases as shown in FIG. 5A, and thereby the liquid level of the ink lowers, causing a negative pressure inside of the tank main body 102. When a negative pressure is present inside of the tank main body 102 without the oil 106 in the middle communication hole 104*b*, air in the middle communication hole 104*b* is likely to be suctioned into the inside of the tank main body 102 through the gas-permeable membrane 105. However, the oil 106 filled in the middle communication hole 104*b* on the atmosphere side of the gas-permeable membrane 105 blocks the air and prevents the air from entering into the inside of the tank main body 102 through the gas-permeable membrane 105.

[Effect]

According to the multifunction apparatus 1 of the first embodiment as described above, the atmosphere communication hole 104 is provided to the sub tank 101 of the recording head 10 mounted on the carriage 11. The gas-permeable membrane 105 is provided to the atmosphere communication hole 104 so as to separate the inside of the tank main body 102 from the atmosphere side. A non-volatile liquid, such as the oil 106, is filled in the atmosphere communication hole 104 on the atmosphere side of the gas-permeable membrane 105.

Accordingly, when ink is pressurizingly supplied, it is possible to let out the air from the inside of the tank main body 102 through the gas-permeable membrane 105 and the oil 106. On the contrary, when a negative pressure is present in the inside of the tank main body 102, such as at the time of image formation, air which is likely to enter the inside of the tank main body 102 through the atmosphere communication hole 104 is prevented from entry by the oil 106.

In other words, it is possible to prevent backflow of air using a simple mechanism, including the gas-permeable membrane 105 and the oil 106, instead of using a mechanical valve mechanism. Also the performance of the backflow prevention mechanism 103 can be maintained for a long time period by using a non-volatile liquid such as the oil 106.

When the atmosphere communication hole 104 is lengthened to have a so-called labyrinth structure, evaporation of the oil 106 as the gas blocking liquid will be suppressed. In this case, the gas blocking liquid need not be a non-volatile liquid such as oil, but may be, for example, water. Then, the manufacturing cost may be reduced.

[Second Embodiment]

In the above described first embodiment, an upper surface (a surface on the atmosphere side) of the oil 106 filled in the middle communication hole 104*b* is not covered, and leakage of the oil 106 is prevented by the pressure loss in the upper communication hole 104*c*. Such a configuration requires a relatively small diameter of the upper communication hole 104*c*, resulting in a so-called labyrinth structure. Accordingly, air released from the inside of the tank main body 102 may not be efficiently discharged into the atmosphere.

Figure 6B:
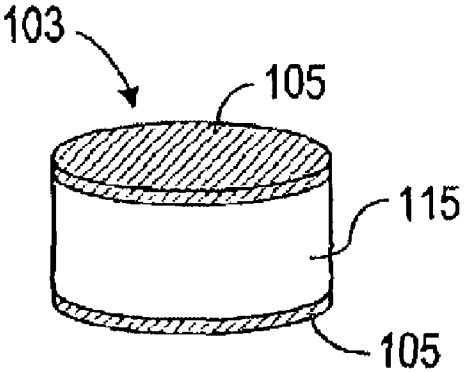
FIG. 6A is a schematic view showing an entire configuration of a sub-tank and a backflow prevention mechanism according to a second embodiment.
FIGS. 6E and 6C are a schematic perspective view and a schematic cross-sectional view of the backflow prevention mechanism, respectively, according to the second embodiment.
Figure 6C:
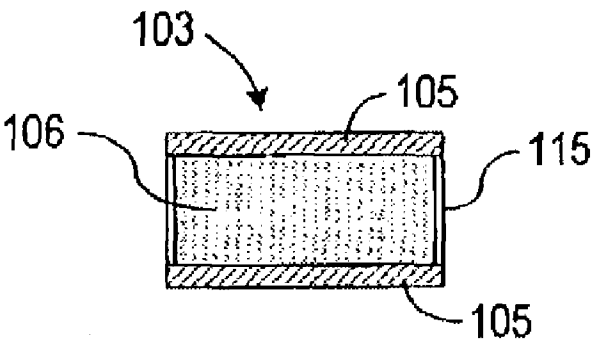

In the second embodiment, therefore, an upper surface of the oil 106 is also covered with another gas-permeable membrane. When the another gas-permeable membrane is disposed on the atmosphere side of the oil 106, a space between the two gas-permeable membrane is always filled up with the oil 106 even when the sub-tank 101 is tiled. Accordingly, even when the sub-tank 101 is tilted, backflow of gas can be prevented by the oil 106. Specifically, as shown in FIG. 6C, a backflow prevention mechanism 103 is integrally configured by a cover 115 cylindrically formed with a material of a resin, a material, or the like, gas-permeable membranes 105, 105 covering both edges of the cover 115, and the oil 106 filled in a hollow part of the cover 115.

Figure 6A:
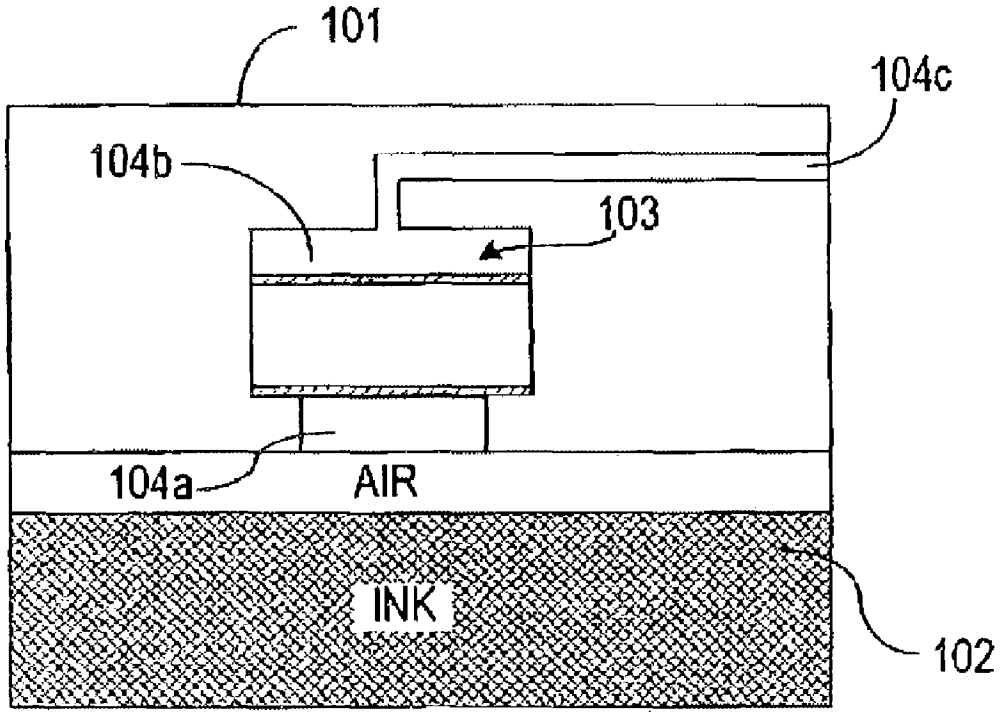

The integrally configured backflow prevention mechanism 103 is fitted in the middle communication hole 104*b*, as shown in FIG. 6A. The backflow prevention mechanism 103 is, for example, pressed into the middle communication hole 104*b* such that a gap is not formed between an inner wall surface of the middle communication hole 104*b* and an outer surface of the cover 115.

With the configuration as described above, even when the sub-tank 101 is placed upside down, for example, while the multifunction apparatus 1 is transported, the oil 106 is received by the gas-permeable membrane 105 on the atmosphere side (the upper side in FIG. 6A). Thus, leakage of the oil 106 is prevented.

Since leakage of the oil 106 is thus prevented by the gas-permeable membrane 105 on the atmosphere side, the upper communication hole 104*c* may have a larger diameter. This allows the air released from the inside of the tank main body 102 to be efficiently discharged into the atmosphere by pressurizing the tank main body 102.

Furthermore the integrally configured backflow prevention mechanism 103 facilitates a simplified assembly of the multifunction apparatus 1 and may result in a reduced manufacturing cost of the multifunction apparatus 1.

[Third Embodiment]

In the above described second embodiment, the backflow prevention mechanism is constituted by two gas-permeable membranes. In the third embodiment, the backflow prevention mechanism is constituted by a single bag-like membrane.

Figure 7B:
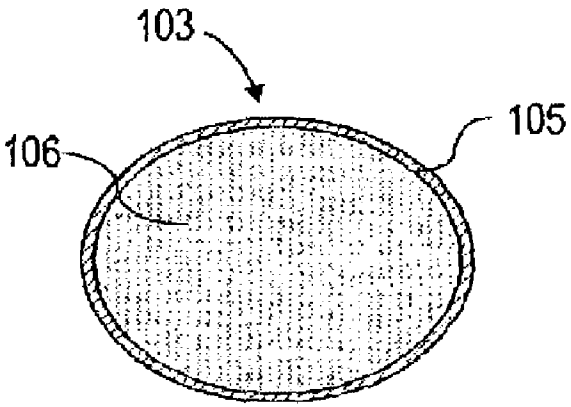
FIG. 7B is a schematic cross-sectional view of the backflow prevention mechanism according to the third embodiment.
Figure 7A:
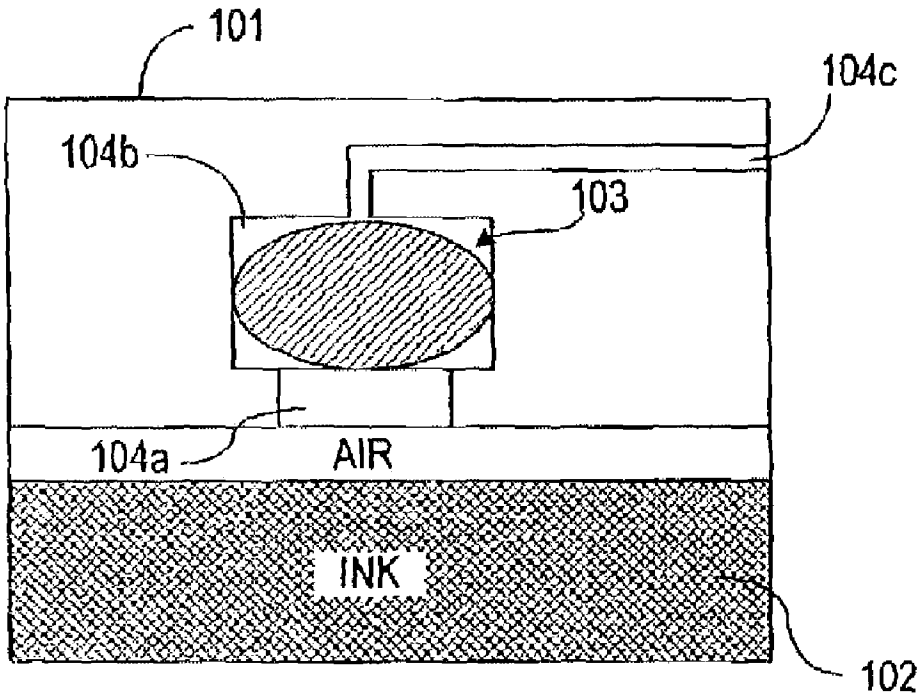
FIG. 7A is a schematic view showing an entire configuration of a sub-tank and a backflow prevention mechanism according to a third embodiment.

Specifically, as shown in FIG. 7B, a gas-permeable membrane 105 is formed into a hollow spherical shape, and the oil 106 is filled in the inside (the hollow part) of the spherical gas-permeable membrane 105 to constitute an integrally configured backflow prevention mechanism 103. As shown in FIG. 7A, the backflow prevention mechanism 103 is fitted in the middle communication hole 104*b* such that a gap is not formed between an inner wall surface of the middle communication hole 104*b* and an outer surface of the cover 115.

With the configuration as described above, even when the sub-tank 101 is placed upside down, for example, while the multifunction apparatus 1 is transported, leakage of the oil 106 is prevented by the gas-permeable membrane 105 covering the oil 106.

Since leakage of the oil 106 is thus prevented by the gas-permeable membrane 105 on the atmosphere side, the upper communication hole 104*c* may have a larger diameter. This allows the air released from the inside of the tank main body 102 to be efficiently discharged into the atmosphere by pressurizing the tank main body 102.

Furthermore, the integrally configured backflow prevention mechanism 103 facilitates a simplified assembly of the multifunction apparatus 1 and may result in a reduced manufacturing cost of the multifunction apparatus 1.

The backflow prevention mechanism 103 in the third embodiment, which is constituted only by the gas-permeable membrane 105 and the oil 106, requires a smaller number of parts than the backflow prevention mechanism 103 in the second embodiment. This may result in a reduced manufacturing cost of the backflow prevention mechanism 103 itself.

To fill the oil 106 in the inside of the integrally formed gas-permeable membrane 105, a tiny hole may be provided in a part of the gas-permeable membrane 105. After filling the oil 106 through the tiny hole, the tiny hole may be closed with a closing material such as an adhesive or a resin. Thus, the oil 106 can be filled in the inside of the gab-permeable membrane 105 without causing an adverse influence on the above described effects.

Although the present invention has been described with reference to the above embodiments, the present invention should not be limited to the embodiments, but may be practiced in various forms.

For examples it may be possible to store a liquid resin in the tank main body 102 in place of the ink, and use a resin plate in place of the recording paper P. Then, there may be provided a lens manufacturing apparatus for manufacturing a resin lense, in which the liquid resin is ejected on the resin plate to form a concave surface or a convex surface on the resin plate.

Furthermore, it may be possible to apply the present invention to a variety of liquid ejecting apparatuses configured such that a liquid stored in a sub-tank is ejected from a nozzle.

One example of such liquid ejecting apparatuses is a soldering apparatus, in which soldering on various printed circuit boards and the like is automatically performed by ejecting melted solder from a nozzle.

Another example is an apparatus for forming an organic membrane, in which a high-polymer organic material (a light emitter) is ejected in an inkjet method, for use in manufacturing an organic EL display.

A further example is an apparatus, in which resin is slurried and is ejected from a nozzle.

What is claimed is:

1. A liquid supplying apparatus for supplying a liquid to an ejecting device, comprising: a liquid storage device that stores the liquid, the liquid storage device including a reservoir having an atmosphere communication hole in an upper portion of the reservoir; a supply device that applies pressure to the liquid and supplies the liquid to the liquid storage device; a first gas-permeable membrane that is permeable to gas but impermeable to liquid, the first gas-permeable membrane being disposed in the atmosphere communication hole; and a gas blocking liquid that prevents entry of gas from an atmosphere side of the first gas-permeable membrane, the gas blocking liquid being filled in the atmosphere communication hole on the atmosphere side of the first gas-permeable membrane, such that the first gas-permeable membrane is disposed on the liquid side of the gas blocking liquid.

2. The liquid supplying apparatus as set forth in claim 1, wherein the atmosphere communication hole on an atmosphere side of the gas blocking liquid is open to an atmosphere through a pipe thinner than the atmosphere communication hole.

3. A liquid ejecting apparatus, comprising: the liquid supplying apparatus as set forth in claim 1; and an ejecting device that ejects the liquid stored in the liquid storage device included in the liquid supplying apparatus toward an ejection target medium.

4. A liquid supplying apparatus for supplying a liquid to an ejecting device, comprising: a liquid storage device that stores the liquid, the liquid storage device including a reservoir having an atmosphere communication hole in an upper portion of the reservoir; a supply device that applies pressure to the liquid and supplies the liquid to the liquid storage device; a first gas-permeable membrane that is permeable to gas but impermeable to liquid, the first gas-permeable membrane being disposed in the atmosphere communication hole; and a gas blocking liquid that prevents entry of gas from an atmosphere side of the first gas-permeable membrane, the gas blocking liquid being filled in the atmosphere communication hole on the atmosphere side of the first gas-permeable membrane, wherein the atmosphere communication hole on an atmospherc side of the gas blocking liquid is open to an atmosphere through a pipe thinner than the atmosphere communication hole and, further comprising a second gas-permeable membrane disposed on the atmosphere side of the gas blocking liquid.

5. The liquid supplying apparatus as set forth in claim 4, wherein the first gas-permeable membrane, the second gas-permeable membrane and the gas blocking liquid are assembled to a hollow cylindrical member which is capable of being fitted in the atmosphere communication hole.

6. The liquid supplying apparatus as set forth in claim 4, wherein the first gas-permeable membrane and the second gas-permeable membrane are formed into a bag- shaped gas-permeable membrane by connecting peripheries thereof and wherein the gas blocking liquid is filled in an inside of the bag-shaped gas-permeable membrane.

* * * * *